US005924533A

United States Patent [19]

Cnockaert et al.

[11] Patent Number: 5,924,533

[45] Date of Patent: Jul. 20, 1999

[54] LUGGAGE CASE

[75] Inventors: Dirk Cnockaert, St. Amandsberg; Willy Van Hoye, Zwijnaarde, both of Belgium; Ian Ferris, Berkshire, United Kingdom

[73] Assignee: Samsonite Corporation, Denver, Colo.

[21] Appl. No.: 08/619,628

[22] PCT Filed: Jul. 14, 1995

[86] PCT No.: PCT/US95/09741

§ 371 Date: Jan. 10, 1997

§ 102(e) Date: Jan. 10, 1997

[87] PCT Pub. No.: WO96/02424

PCT Pub. Date: Feb. 1, 1996

[30] Foreign Application Priority Data

Jul. 15, 1994 [GB] United Kingdom ..... 9414354

[51] Int. Cl.[6] ..... A45C 5/14; A45C 13/30

[52] U.S. Cl. ..... 190/18 A; 190/109; 190/115; 190/121

[58] Field of Search ..... 190/109, 115, 190/119, 121, 18 A

[56] References Cited

U.S. PATENT DOCUMENTS

| | | | |
|---|---|---|---|
| 1,299,291 | 4/1919 | Blanke | 190/119 |
| 1,610,146 | 12/1926 | Panzer | 190/109 |
| 1,873,773 | 8/1932 | Lish | 190/109 |
| 1,908,178 | 5/1933 | Plotkin . | |
| 2,091,651 | 8/1937 | Platt . | |
| 2,115,362 | 4/1938 | Freysinger | 190/109 |
| 2,245,999 | 6/1941 | Plotkin | 190/109 |
| 2,390,544 | 12/1945 | Lamb | 190/115 |
| 3,112,017 | 11/1963 | Lifton | 190/109 |
| 3,298,479 | 1/1967 | Palmer et al. | 190/109 |
| 3,497,041 | 2/1970 | Samhammer | 190/115 |
| 3,526,921 | 9/1970 | Aupke | 190/18 A |
| 3,876,247 | 4/1975 | Chilewich . | |
| 3,912,055 | 10/1975 | Malooly | 190/109 |
| 3,982,613 | 9/1976 | Wood . | |
| 4,116,514 | 9/1978 | Lawrence | 339/4 |
| 4,385,415 | 5/1983 | Volz | 190/18 A |
| 4,509,622 | 4/1985 | Morszeck | 190/119 |
| 4,550,813 | 11/1985 | Browning . | |
| 4,621,404 | 11/1986 | Browning | 190/115 |
| 4,663,803 | 5/1987 | Gora | 220/337 |
| 4,838,396 | 6/1989 | Krenzel . | |
| 4,928,800 | 5/1990 | Green et al. . | |
| 5,048,649 | 9/1991 | Carpenter et al. | 190/115 |
| 5,111,918 | 5/1992 | Bako et al. . | |
| 5,154,265 | 10/1992 | Capistrant . | |
| 5,178,244 | 1/1993 | Liang . | |
| 5,181,166 | 1/1993 | Howell | 220/336 |
| 5,197,578 | 3/1993 | Van Hooreweder | 190/115 |
| 5,197,579 | 3/1993 | Bieber et al. | 190/115 |
| 5,407,038 | 4/1995 | Pedlar | 190/18 A |
| 5,560,458 | 10/1996 | Franklin et al. | 190/115 |

FOREIGN PATENT DOCUMENTS

| | | | |
|---|---|---|---|
| 9441 | 3/1928 | Australia | 190/115 |
| 694252 | 7/1953 | United Kingdom | 190/57 |
| 1019400 | 2/1966 | United Kingdom | 190/109 |

*Primary Examiner*—Stephen P. Garbe
*Attorney, Agent, or Firm*—Gregory W. O'Connor

[57] ABSTRACT

A luggage case comprises a lid shell (11) and a base shell (12) connected together by a hinge (22). The edges of the shells can be fastened together by latches (23, 24, 25). Two latches (23, 24) are mounted on the lid shell at the end walls. When they are released, they project downwardly and outwardly to provide gripping elements for opening the case. The case has two wheels (70, 71) and a steering handle (74) for rolling the case in a two-wheeled mode. Two castors (72, 73) are located on the back wall, and a pulling handle (76) is provided on the front wall. The pulling handle can be used for pulling the case on the wheels and the castors in four-wheeled mode. The carrying handle (21) is fixed to the frame (22) so as not to pivot. It is made of thermoplastic rubber to allow twisting movement for the comfort of the traveller. The latch (25) operates easily under carrying handle (21).

25 Claims, 12 Drawing Sheets

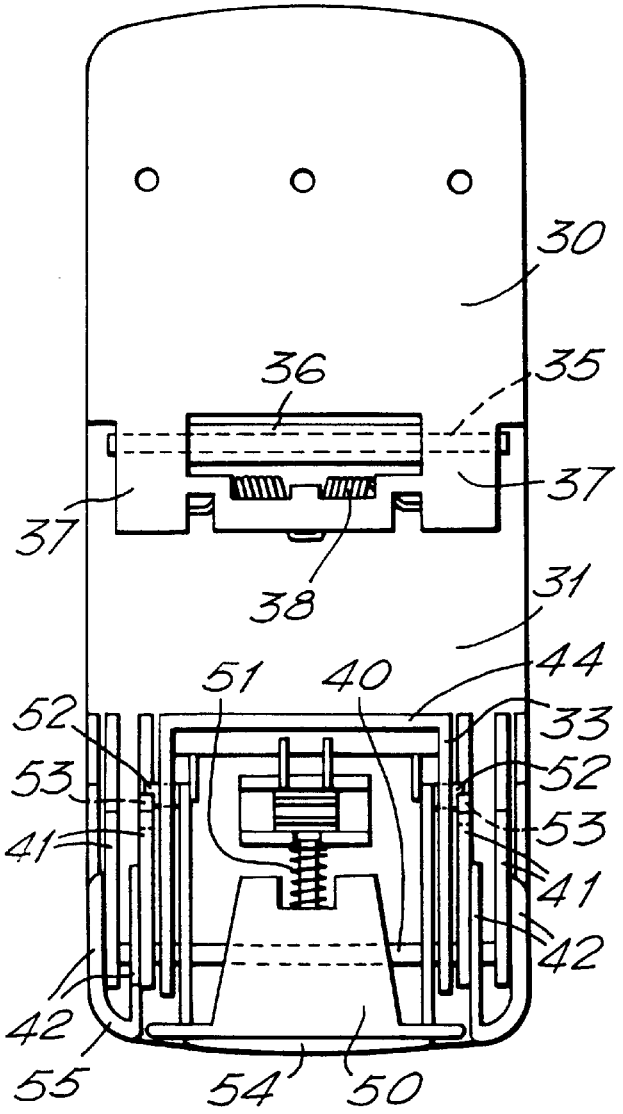
FIG. 7.
FIG. 6.
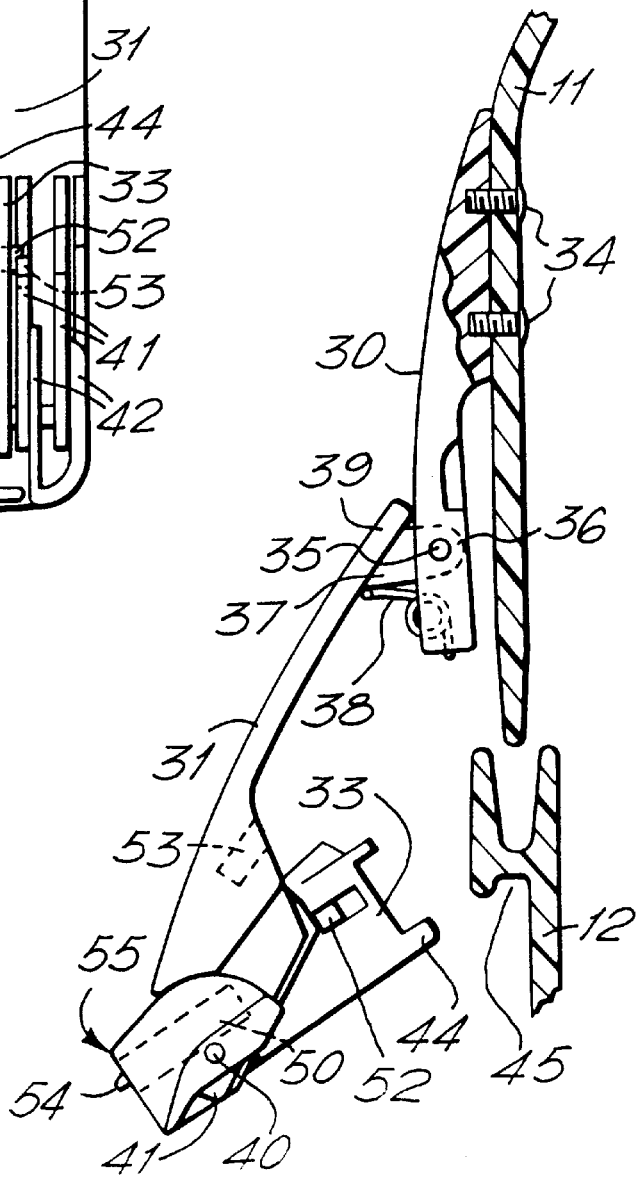

LUGGAGE CASE

The present invention relates to luggage cases and is particularly concerned with luggage cases moulded from plastics material.

A conventional luggage case of plastics material comprises two shells, each having a peripheral side wall, the side walls forming the front, back and end walls of the case. The two shells are hinged together at the back walls and have latches for releasably fastening the edges of the cases together when the case is closed.

Usually, such cases have a protruding lip running around the edge of each shell at the place where the shells meet to provide stiffness to the otherwise flexible shell. A metal frame may be included around part or all of the frame to provide additional stiffness.

In many designs of case, the projecting lip also provides the means for gripping the lid of the case to open the case when the shells are released. The need to provide a lip for this purpose places a constraint on the designer of luggage cases.

According to the present invention in a first aspect, a luggage case comprising a base shell and a lid shell, each shell having a peripheral side wall, the side walls forming the front, back and end walls of the case, the two shells being hinged together at the back wall and having at least one latch for releasably fastening the shells together when the case is closed, at least a portion the latch being mounted on the lid shell and being arranged to project away from the peripheral side wall when the latch is released so as to provide means for gripping and raising the lid shell to open the case.

With this arrangement, it is no longer necessary to provide the lid shell with a projecting lip for gripping when opening the case. In a preferred construction of the case, the edge of the lid shell fits into a channel in the edge of the base shell. This enables a case with a rounded contour to be constructed.

Preferably the latches are of a toggle construction designed to pull the two shells together as they are closed. Preferably the latches fit into a recess in the peripheral wall of the shell so as not to project substantially when fastened.

Two latches may be mounted on the end walls of the case near the front of the case. Two such latches may be provided, one at each end. With this arrangement the latches are easy to grip for opening the case.

The present invention is also concerned with the problem of handling heavy cases. It is know to provide cases with wheels or castors for transporting the case when heavily filled. In one construction a pair of wheels is located at the corner of the case between the back wall and one of the end walls. Such cases are intended to be tilted at an angle to run on the wheels and a steering handle may be provided near the front of the opposite end wall. Another type of case has four castors on the back wall of the case. The case rests on the castors with the front wall uppermost and is pulled along on the ground by a strap or handle.

According to the present invention, a luggage case comprising a base shell and a lid shell, each shell having a peripheral side wall, the side walls forming the front, back and end walls of the case, a carrying handle on the front wall of the case, the case having two coaxial wheels mounted at the corner of the case between the back wall and one of the end walls and two castors mounted on the back wall, and including at least one additional handle for pulling the case on the wheels and the castors, or for steering the case when tilted onto the two wheels. With this arrangement of case the traveller can wheel the case either on two wheels or four according to preference and to suit the circumstance.

The case may include a steering handle at or near the corner of the case diagonally opposite the wheels. In addition or alternatively, it may include a pulling handle in the same region.

Cases of known construction are usually joined together at their back walls by a single hinge pin which passes through holes in hinge knuckles. Thieves have found it possible to gain access to such cases even when locked by pushing out the hinge pin.

According to the present invention in a third aspect there is provided a luggage case comprising a base shell and a lid shell, each shell having a peripheral side wall, the side walls forming the front, back and end walls of the case, the two shells being connected together at the back wall by a hinge means and having at least one latch for releasably fastening the shells together when closed, the hinge means comprising interengaging hinge knuckles on the edges of the back walls of the respective shells, and two coaxial hinge pins inserted from opposed ends though aligned holes in the knuckles, an obstruction being provided on one side of the shells between the aligned holes to prevent each hinge pin being pushed out of the holes through the end through which it is inserted.

With this arrangement, the hinge pins can only be extracted from the ends in which they are inserted. It is not possible to push the hinge pins out through the opposite end because of the obstruction.

It is known to provide luggage case with a pulling handle for pulling the case along the ground when resting on four wheels or castors. In one known arrangement, the pulling handle is attached to a retractable strap. The strap is attached to a linear spring which extends down the inside of an end wall of the case. The strap passes over a pulley near the back wall of the case. The length of strap required for conveniently pulling a case is greater the smaller the case is because the front wall of the case is closer to the ground. However with the linear spring arrangement, the length of strap that can be accommodated is restricted in small cases.

According to the present invention in a fourth aspect there is provided a luggage case having top, bottom, front back and end walls, four wheels or castors being mounted on the back wall and a pulling handle assembly near the corner between the front wall and one of the end walls, the pulling handle assembly comprising a pulling strap attached at one end to a spool mounted inside the case, the spool being spring loaded so as to wind in the strap when not in use, the strap passing to the outside of the case through a slot in the wall of the case and a handle grip being attached to the outer end of the strap, a recess being provided in the outside of the case at the said corner and the handle grip being shaped to fit into the recess when not in use.

With this arrangement, the length of strap that can be accommodated is restricted by the size of the case and, if desired, the same unit can be used in a range of cases of different sizes.

It is desirable to be able to open cases fully in order to have access for packing the lid of the case as well as the base. When a case is provided with castors the castors may limit the extent to which the case may be opened.

According to the present invention in a fifth aspect, there is provided a luggage case comprising a base shell and a lid shell, each shell having a peripheral side wall, the side walls forming the front, back and end walls of the case, the two shells being hinged together at the back wall and having at least one latch for securing the case together when closed, at least two castors, one of the said castors being mounted on the back wall of each of the shells, the castors being spaced at different distances from the hinge axis, a recess being provided between the castor furthest from the axis and the hinge axis to accommodate the castor on the other shell when the case is fully opened.

When a luggage case is being carried on the roof of a car it may be exposed to rain. In order to provide rigidity and for other reasons, it may be desirable to form the edge of the base shell with inner and outer lips with a channel between them which receives the edge of the lid shell. With such a construction however there is a possibility that rain falling on the case may collect in the channel and enter the suitcase damaging its contents.

According to the present invention in a sixth aspect there is provided a luggage case comprising a base shell and a lid shell, the two shells being joined together by a hinge, the edge of the base shell being formed with an inner lip and an outer lip with a channel between the inner and outer lips, the inner lip extending around the entire case, the outer lip extending around the entire case except in the region of the hinge, the edge of the lid shell being received in the channel between the inner and outer lips when the case is closed, the inner lip being higher than the outer lip around the entire periphery of the case. With this arrangement, if water collects in the channel it will overflow to the outside of the case before it can overflow the inner lip and damage the contents of the case.

In many constructions of case, the carrying handle is pivoted to the base shell so that it can accommodate the swaying movement of the case as the case is carried pivoting handle also may prevent the handle being damaged in use. There are however situations where it is desired that the handle should not be able to pivot about a longitudinal axis. Such cases can be uncomfortable to carry because the swaying movement of the case makes the handle turn in the hand of the user.

According to the present invention in a seventh aspect, there is provided a luggage case comprising a base shell and a lid shell, the two shells being hinged together, and at least one latch for holding the case together when closed, and a carrying handle, the carrying handle being fixed to the wall of the case at its ends so as not to pivot relative to the case, at least a portion of the handle being made of a material that allows torsional twisting when the case is firmly held by the handle and the case sways from side to side. With this arrangement, the swaying movement of the case is accommodated by the torsional twisting of the handle.

In some constructions of case it is desired to provide a central latch in the front wall of the case. If the handle is a fixed handle, access to the latch may be restricted and therefore the latch may be difficult to operate.

According to the present invention in a eighth aspect, there is provided a luggage case comprising a base shell and a lid shell, the two shells being hinged together, a carrying handle and a latch for holding the shells together when the case is fastened, the latch being located between a gripping portion of the carrying handle and the wall of the case and being of the type that draws the edges of the shells together as it is fastened, the latch being mounted on one of the shells and having a claw hook for engagement with a portion of the other shell, the latch including an operating lever being coupled to the claw portion by a linkage, which when the lever is operated to fasten the case, causes the claw portion first to move towards the wall of the other shell and then to be drawn towards the said one shell. With this arrangement, operation of the latch is facilitated.

In some cases it is desired to be able to divide the space between the lid shell and the base shell with a panel. Such panels are usually hinged to the back wall of the case and have clips for securing the front edge of the case to the lid shell. One conventional form of clip consists of a turnbuckle. Such arrangements can however be difficult to operate, particularly where single-handed operation is required.

According to the present invention in a ninth aspect, there is provided a luggage case comprising a base shell and a lid shell, the two shells being hinged together along a back wall of the case, and a panel within the case for dividing the space within the lid shell from the space within the base shell, the panel being attached at its back edge to the interior of the back wall and having means for detachably securing its front edge to the lid of the case, the said means comprising loop attached to the pad and a hook attached to the inside of the lid shell, a resilient detent being position to prevent the loop from accidentally disengaging from the hook.

An embodiment of the invention will now be described, by way of example, with reference to the accompanying drawings of which:

FIG. 6 shows a side elevation, partly in section, of a side latch of the case;

FIG. 7 shows a rear elevation of the latch of FIG. 6;

FIGS. 23*a* through 23*d* show orthogonal views of the hook portion of the catch as it would be executed in a two part construction.

Figure 24A:
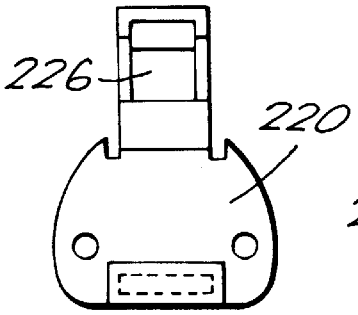
Figure 24B:
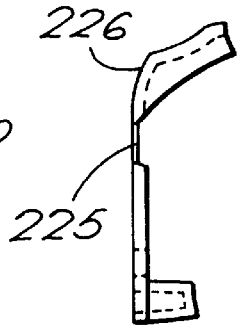
Figure 24C:
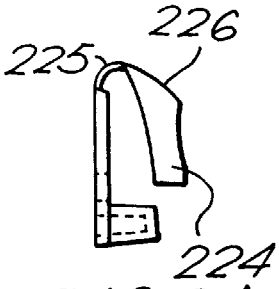

FIGS. 24*a* and *b* show orthogonal views of the resilient detent portion of the catch for the two part construction, and FIG. 24*c* shows the resilient detent portion of FIGS. 24*a* and 24*b* in a flexed position.

Referring to the drawings, these show a luggage case 10 comprising two shells, a lid shell 11 and a base shell 12, each formed as a single moulding from plastics material. Each shell has a peripheral wall 13 and 14 respectively, and the two shells together form the front 14, back 15, top 16, underneath 17 and end walls 18 and 19 of the case. The edge of the base shell is of thicker section than the rest of the base shell so as to form an integral frame running entirely around the base shell. A carrying handle 21 is mounted on the frame 20 on the front wall of the case. The two shells 11 and 12 are connected together at the back wall 15 by a hinge 22.

The edges of the two shells are held together when the case is closed by three latches. Two side latches 23 and 24 are mounted on the lid shell 11 and positioned on the end walls. In the embodiment they are shown near the front of the case between the mid-point of the end walls and the front wall. A third latch 25 is mounted on the base shell on the front wall 14 underneath the gripping portion of the handle 21. All three latches are of the type that draw the edges of the case together with a toggle action as they are fastened.

Referring now to FIGS. 6 and 7, the construction of the side latches will be described in detail.

The side latch 23 comprises a mounting portion 30, a body portion 31, and a latch portion 33. The mounting portion 30 is secured to the wall of the lid shell 11 by screws 34 which pass through the wall into the mounting portion. The base portion 31 is pivotally connected to the mounting portion 30 by a hinge pin 35 which passes through aligned holes in lugs 36 and 37 on the mounting portion and the base portion respectively. A spring 38 acts between the mounting portion and the base portion to bias the base portion so that its lower end is urged away from the end wall of the base shell. Part of the body portion projects above the hinge pin 35 to form an abutment 39 which engages part of the mounting portion to limit the movement of the lower end of the body portion away from the case in the open position shown in FIG. 6. The hinge pin 35 extends generally parallel to the end wall of the case and to the edge of the shell.

The latch portion 33 is connected to the body portion 31 near its lower end by a hinge pin 40 which passes through aligned holes in lugs or flanges 41 and 42 on the body portion and latching portion respectively. The pivot pin 40 is parallel to the pivot pin 35.

The main part of the latching portion projects upwardly from the hinge pin 40 and is formed at its upper end with an abutment portion 44 which cooperates with a recess 45 formed by a lip on the outside of the end wall of the base shell 12.

The latch portion is pivotal about the pivot pin 40 between an open position in which it is inclined upwardly away from the body portion 31 and towards the wall of the case and a closed position in which it projects upwardly and lies close to the body portion. The lugs or flanges 41 and 42 on the latch portion and the body portion bear resiliently against one another to provide a frictional resistance to rotation of the latch portion relative to the body portion. A catch mechanism 50 is located in the lower end of the latch to hold the latch in the closed position. The catch 50 is mounted for sliding movement in the latching portion and is biased downwardly by a spring 51. Tabs 52 carried by the sliding portion engage in slots 53 on the body portion to hold the latch portion in the closed position. To release the latch a gripping portion 54 on the lower end of the catch 50 is pushed upwardly against the spring 51 to move the lugs 52 out of the slots 53 and permit the latch to be rotated from the closed position to the open position.

The lower portion 55 of the latch portion forms the part that is gripped by the user when opening the case. The pivot pin 40 is located closer to the wall of the case than the gripping portion 55 so that when the catch 50 is released, upwards pressure on the gripping portion 55 tends to rotate the latch portion from the closed position to the open position. This rotation is further facilitated by the biasing action of the spring 38 moving the body portion into the opened position whilst the abutment 44 is engaged in the recess 45 under the lip at the edge of the case. Once the latch is in the fully open position as shown in FIG. 6, the abutment 44 is clear of the lip so that the lid can be raised and the case opened.

It will be noted that the body portion forms an angle of less than 40°, approximately 20°, in the open position so that the latches point downwardly and outwardly when released. The lower end of the latches 23 and 24 can be gripped by the user and provide a convenient means for opening the case. This is particularly important with a case such as is shown in the drawings where the edge of the lid shell fits within the edge of the base shell and there is no flange or other projection which can conveniently be gripped to hold the shell. It is also to be noted that the weight of the lid shell is transmitted through the body portion to the gripping portion of the latch portion and that the delicate parts of the catch do not transmit these forces.

To close the case when the lid is lowered, the lower end of the latch is pushed inwardly against the action of the spring 38 so that the abutment 44 engages in the recess 45. As the lower end of the latch is pushed inwardly, the two shells are drawn together. It is to be noted that the point of contact between the abutment 44 and the recess 45 moves from a position inside the plane joining the pivot pins 35 and 40 to a position just outside this plane so that the latch is closed with a toggle action.

Figure 9:
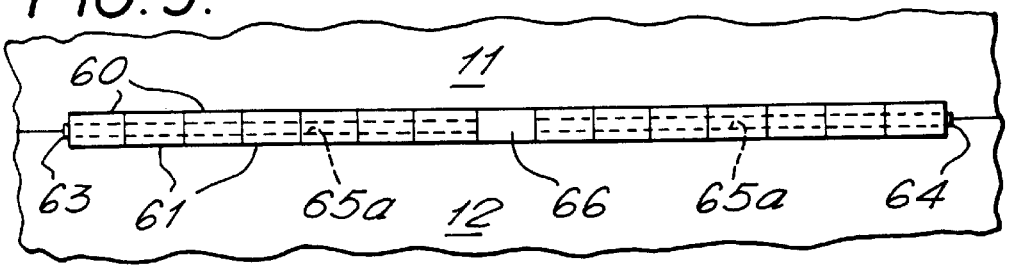
FIG. 9 shows a detail of the hinge construction.

FIG. 9 of the drawings shows the detail of the hinge construction.

The hinge is formed by knuckles 60 and 61 moulded on the edges of the lid and base shells 11 and 12 respectively. The knuckles are interengaged and hinge pins 63 and 64 are inserted from opposite ends into aligned holes 65A and 65B passing through the hinge knuckles. The aligned holes do not pass through all the hinge knuckles. One of the knuckles 66 has no hole passing through it so as to form an obstruction. The pins therefore cannot be pushed from the outer ends beyond the obstruction 66.

A problem with a conventional case having a single hinge pin running the length of the back wall of the case is that a thief can sometimes gain access to the case even when locked by pushing the hinge pin out through the holes in the hinge knuckles. By including the obstruction 66, the hinge pins cannot be removed in this way since they can only be removed by pulling them out of the ends through which they have been inserted. The pins 63 and 64 are of such a length that when fully inserted the amount projecting beyond the end of the hinge knuckles is insufficient to grip to extract the hinge pins.

The luggage case 10 is provided with two wheels mounted on stub axles at the corner of the case between the end wall 19 and the back wall 15. The rotational axes of the wheels 71 and 72 are coaxial. On the back wall of the case near the end wall 18 are mounted two castors 72 and 73. The castors are mounted for swivelling movement about axes which are vertical when the case is standing with its back wall lowermost.

Figure 1:
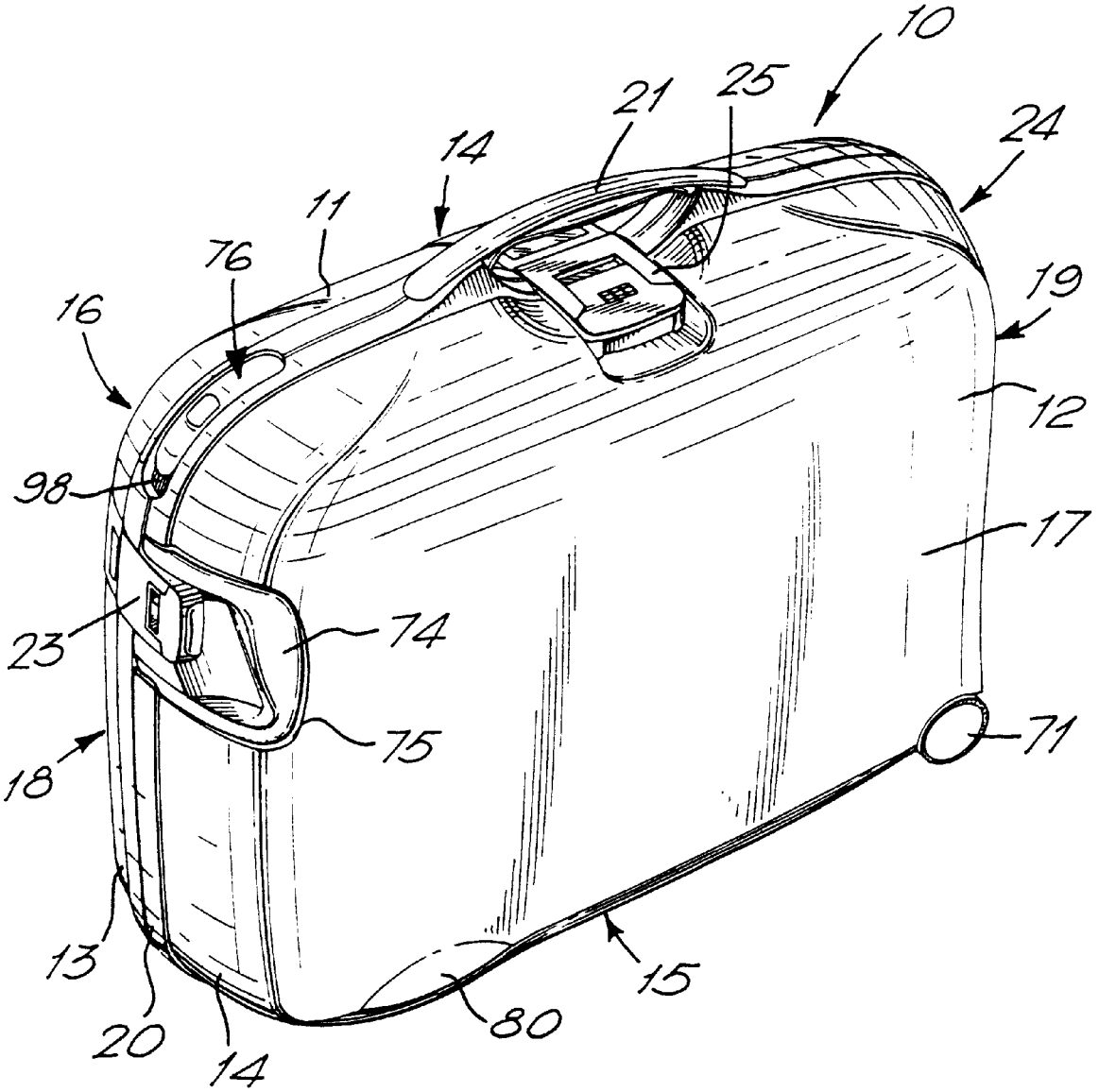
FIG. 1 shows a perspective view of a case in accordance with the invention.
Figure 2:
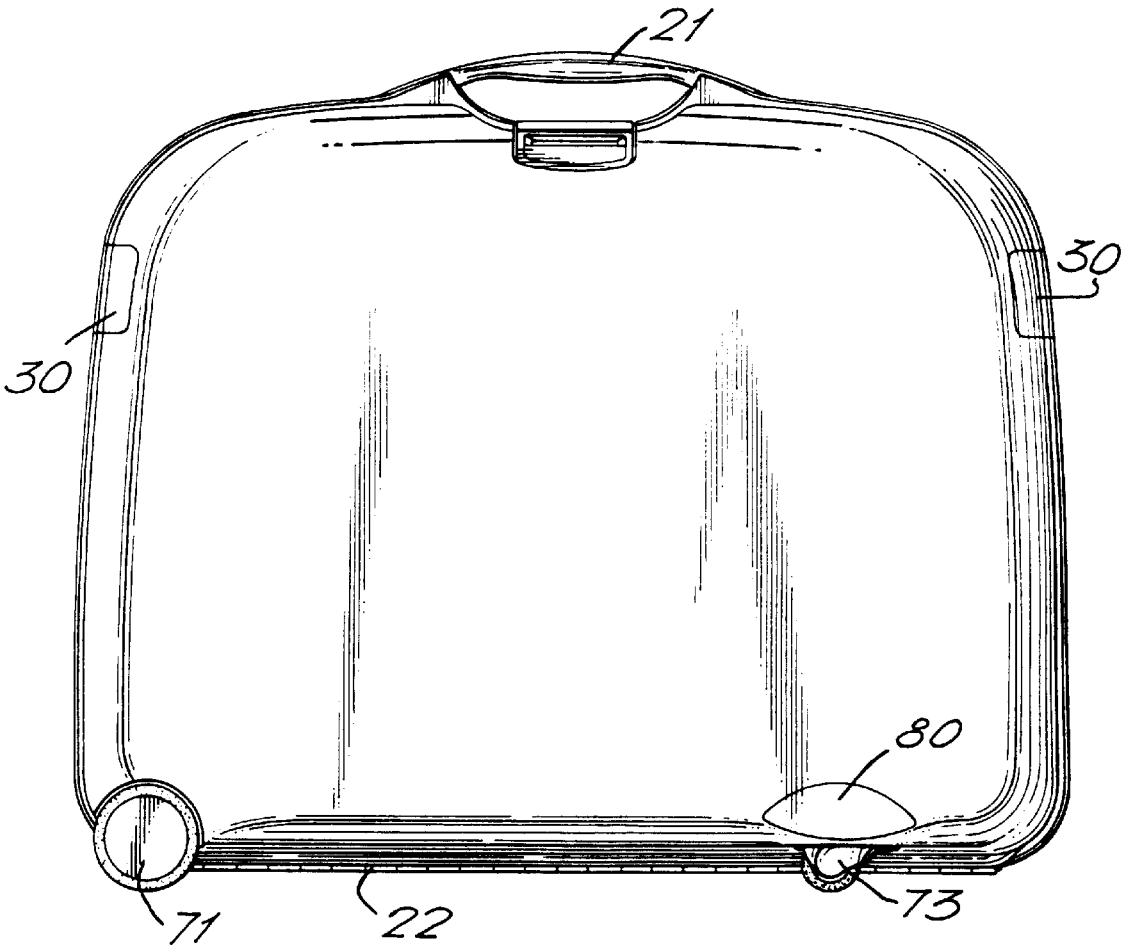
FIG. 2 shows a top plan view of the case.
Figure 10:
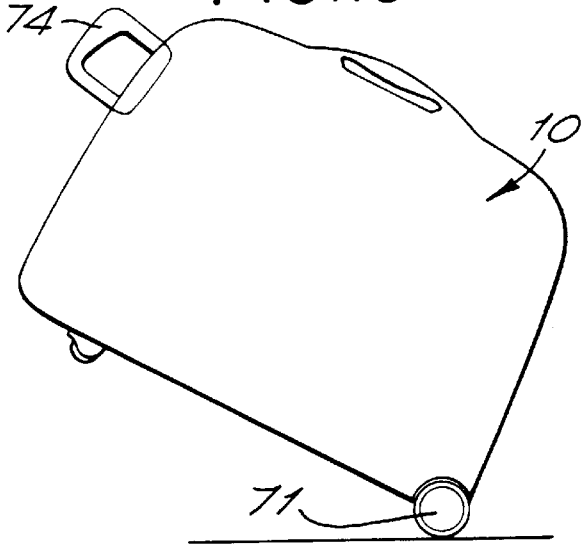
FIG. 10 shows a sketch of the case being used in two wheel operation.
Figure 8:
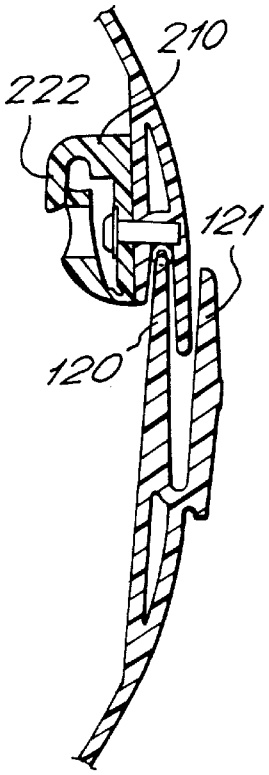
FIG. 8 shows a detail of the wall construction.

On the end wall 18 of the case is mounted a folding pulling handle 74. As shown in FIG. 1, the pulling handle can be folded into a retracted position in which it is located in a recess 75 in the end wall of the case. The pulling handle 74 can be pivoted outwardly into an extended position as indicated diagrammatically in FIG. 10 to form a pulling or steering handle enabling the case to be tilted so as to run on the two wheels 70 and 71.

Figure 11:
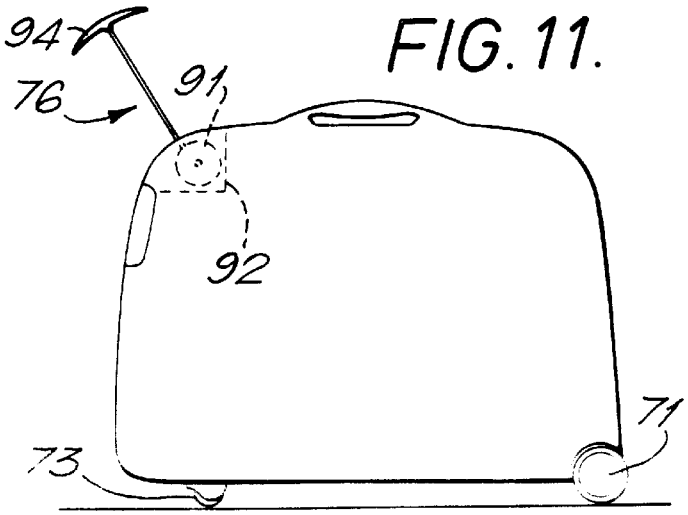
FIG. 11 shows a detail of the case being used in four wheel operation.

At the corner between the front wall 14 and the end wall 18 is a retractable pulling handle 76. The retractable pulling handle can be extended as shown diagrammatically in FIG. 11 to allow the case to be pulled along the ground standing on the two wheels 70 and 71 and the two castors 72 and 73. Thus, the case can be manoeuvred either on two wheels or on four wheels depending on the user's preference and the circumstances.

Figure 3:
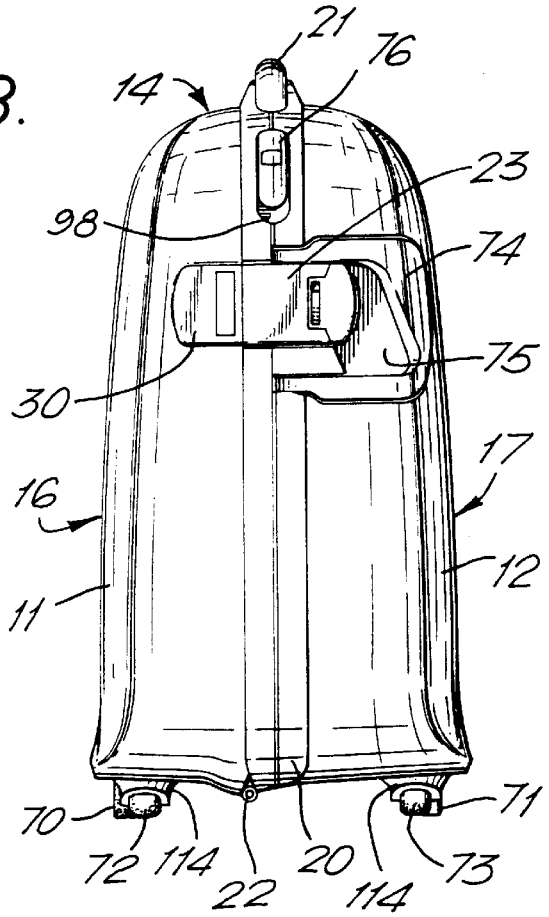
FIG. 3 shows an end elevation of the case.

As can be seen in FIG. 3, the top wall 14 of the case diverges from the bottom wall 17 from the front towards the back so as to give the case a generally wedged shaped appearance when viewed from the ends. As can be seen from FIG. 1 and FIG. 4, the walls of the base and lid shells are flared outwardly in the region 80 around the castors 70 and 73. These features enable the wheels 70 and 71 and the castors 72 and 73 to be spaced as close to the top and bottom walls of the case as possible giving the case greater stability than otherwise would be the case.

Figure 12:
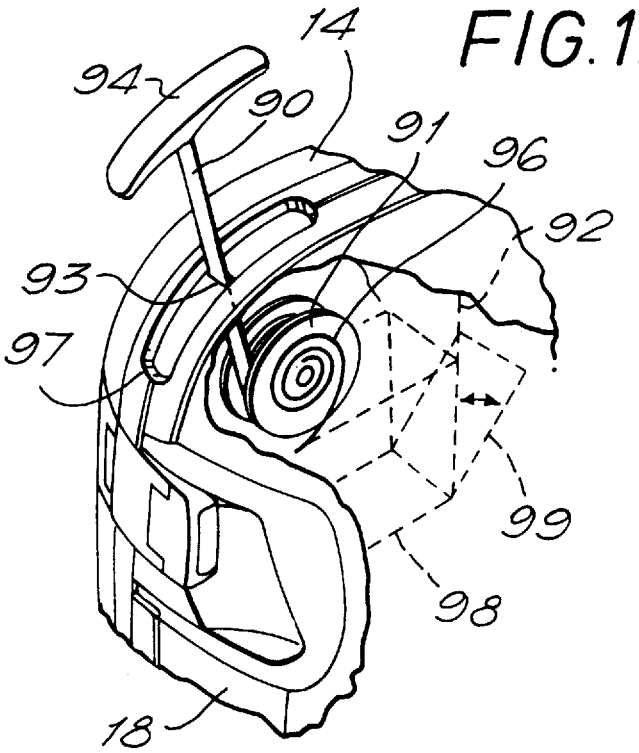
FIG. 12 shows a perspective sketch of the pulling handle construction.

FIG. 12 shows in diagrammatic form the construction of the pulling handle 76. A strap 90 is attached at one end to a spool 91 located in an enclosure 92 on the inside of the case at the corner between the end wall 18 and the front wall 16 The strap 90 passes through a slot 93 in the wall of the case and is attached to a handle grip 94 on the outside of the case. A spring 96 operates between the drum 91 and the enclosure 92 so as to urge the drum to rotate in one direction winding in the strap 90 when not in use.

A recess 97 is formed in the frame 20 on the outside of the case at the corner between the front wall 14 and the end wall 18. The recess is elongate along the direction of the frame and curves around the corner. The handle grip 94 is similarly elongate and curved so as to fit in the recess 97. When the pulling handle is not in use, the spring 96 causes the strap to be wound in on the spool 91 and the handle grip 94 fits into the recess 97 so as to not to project from the overall outline of the case.

The handle grip 94 is shorter in length than the recess 97 so as to provide a space 98 into which the user can insert a finger to lift the handle grip out of the recess when he wishes to use the pulling handle.

As illustrated in FIG. 12, the pulling handle assembly is located in the enclosure 92 on the inside of the base shell near the edge of the shell. This forms a space between the enclosure 92 and the bottom wall 17 of the case into which a security box 98 is inserted for holding valuables, keys or the like. The box 98 is moulded from plastics material and has a lid 99 which is connected to the main portion of the box by an integral hinge. Locating the security box in this position renders it less visible when the case is opened and makes use of what otherwise would be redundant space.

By providing an arrangement in which the pulling strap is wound on a drum rather than the known arrangement in which it is passed down the inside of the end wall of the case and over a pulley to a linear spring, the pulling handle assembly is more compact and the same unit can be used for different sizes of case. The length of strap required is greater the smaller the size of the case because the front wall is closer to the ground when being pulled. With the linear arrangement the space available in a small case may not be sufficient from a convenient length of pulling strap to be accommodated. The construction described avoids this difficulty.

The castor and wheel construction now will be described in greater detail.

Figure 4:
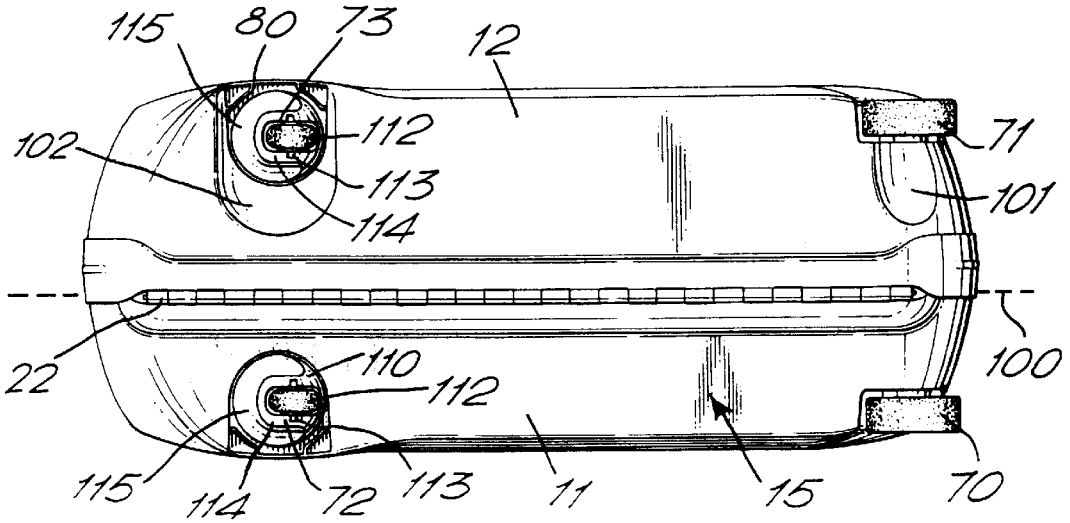
FIG. 4 shows a rear elevation of the case.
Figure 13:
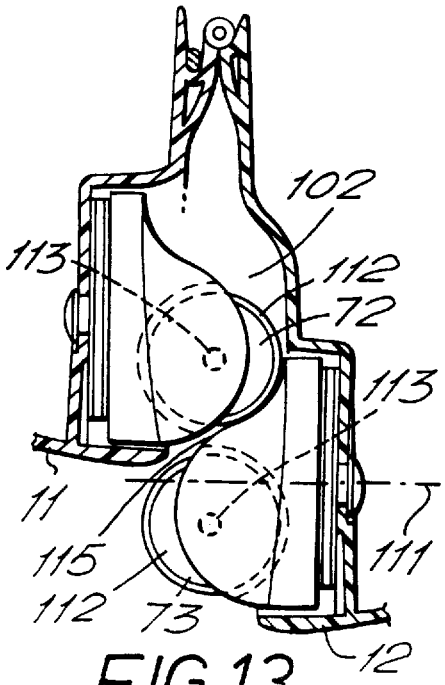
FIG. 13 shows a detail view of the case in the open condition.
Figure 14:
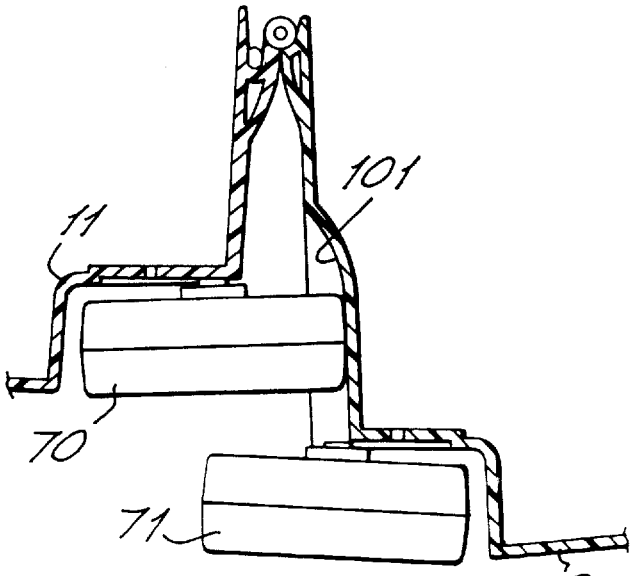
FIG. 14 shows a further detail of the case in the open condition.
Figure 15:
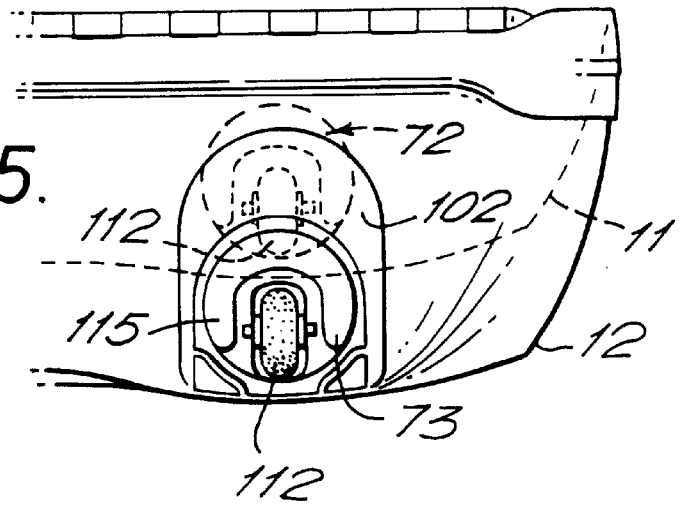
FIG. 15 shows a sketch of the castors in the open condition.

As can be seen in FIG. 4, the base shell 12 is deeper than the lid shell 11 so that the wheel 71 on the base shell is spaced further from the hinge access 100 than the wheel 70 on the lid shell and the castor 73 on the base shell is spaced further from the hinge axis than the castor 72 on the lid shell. A recess 101 is formed in the outside of the back wall of the base shell adjacent the wheel 71 between the wheel 71 and the hinge axis 100. Similarly, a recess 102 is formed in the outside of the back wall of the base shell adjacent the castor 73 between the castor 73 and the hinge axis 100. The recesses 101 and 102 accommodate the wheel 70 and the castor 72 respectively when the case is fully opened as shown in FIGS. 13 and 14.

Each castor 72 and 73 is constructed with a portion 110 which swivels about the swivel axis 111 and carries the castor wheel 112 on a wheel axis 113. The swivelling portion 110 includes a shroud portion 114 which extends down around the castor wheel to protect it from damage by objects lying on the ground.

The wheel axis 113 of the castor is offset from the swivel axis in the conventional manner so that the weight of the castor wheel tends to cause the castor to adopt a particular orientation with the castor wheel below the swivel axis when the case is placed with its bottom wall on the ground. As can be seen from the drawings, the swivel portion of the castor is cut away by a recess 115 on the side which is opposite the castor wheels. As a consequence, the swivelling portion has asymmetry about the swivelling axis and the centre of gravity of the swivelling portion is offset from the swivelling axis in the same direction as the offset of the castor wheel axis. This offsetting of the centre of gravity of the swivelling portion enhances the tendency of the castors to orientate themselves with the castor wheel axis below the swivel axis when the case is horizontal.

It is to be noted that the recess 102 would not be large enough to accommodate the castor 72 when the case is open if the swivel portion did not include the recess 115. By providing the recess 115 on the castor wheel 73 on the base shell, the swivelling portion provides clearance for the castor wheel 112 of the castor 72 on the lid shell when the case is fully opened. The recess 115 extends from the side that is uppermost when the case is opened around the swivelling portion to the sides that face horizontally. With this arrangement, clearance is provided even if the castors do not swivel fully into the position where the castor wheel lies immediately below the swivel axis, for example if there is some sticking in the swivelling action or if the case is not on a truly horizontal surface.

Figure 16:
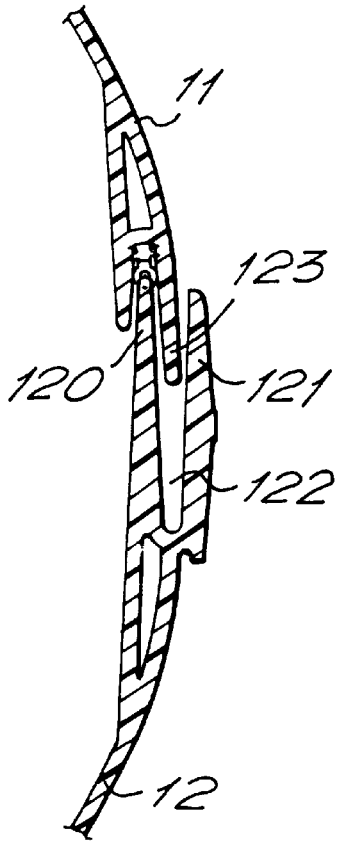
FIG. 16 shows a cross-section through the rim of the case.
Figure 17:
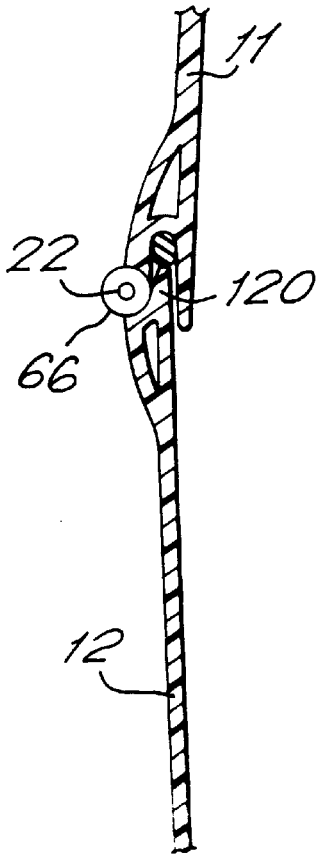
FIG. 17 shows a cross-section through the rim of the case in the region of the hinge.

FIGS. 16 and 17 show the edge construction of the case. As can be seen in FIG. 16, the base shell is formed at its edge with an inner lip 120 and an outer lip 121, a channel 122 being formed between the inner and outer lips. The channel 122 accommodates the edge 123 of the lid shell when the case is closed and gives the closed case rigidity and security from objects falling out. The edge construction of the case is substantially as shown in FIG. 16 around the entire periphery of the case except in the region of the hinge. FIG. 17 shows the construction in this region. The outer lip 121 is replaced by the knuckles 60 of the base shell. Around the entire periphery of the case, the inner lip 120 is higher than the outer lip 121.

In use, if the case is exposed to rain, for example by being mounted on the roof rack of a car, water may run down the outside of the lid shell and collect in the channel 122. By ensuring that the inner lip 120 is, at all points, higher than the outer lip 121, the construction ensures that water collecting in the channel overflows to the outside before it reaches a level where it can overflow into the interior of the case. Thus, the case can be constructed without an elastomeric seal in the channel to prevent ingress of water.

Figure 18:
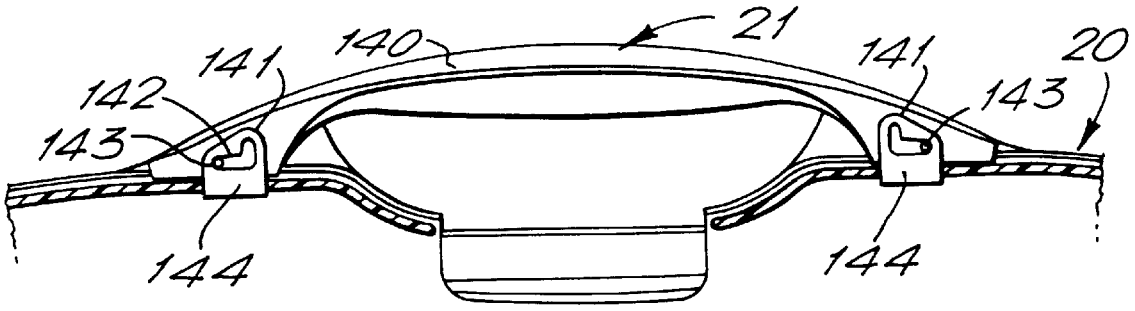
FIG. 18 shows a detail of the handle construction.

FIG. 18 shows details of the carrying handle construction. The carrying handle 21 comprises a gripping portion 140 made from a material that is sufficiently tough and rigid to be self supporting and to bear the weight of the case but which allow torsional twisting. A suitable material is thermoplastic rubber. The moulded handle is secured to the frame portion 20 of the base wall of the case by means of U-shaped brackets 141 mounted on the front wall of the case. Pins 143 pass through L-shaped slots 142 in the limbs 144 of the U-shaped brackets and through the ends of the handle 140 to secure the handle to the frame. The pin and slot arrangement allows limited movement of the ends of the handle relative to the frame in the longitudinal direction of the handle. The handle is fixed to the case so as to allow no pivoting movement about an axis parallel to the longitudinal direction of the handle. However, by using thermoplastic rubber or similar material for the handle which allows limited torsional twisting movement, the handle can accommodate swaying movement of the case as the case is carried without the gripping portion turning in the hand of the user. The construction of the handle therefore makes the case more comfortable to carry than it would be if the handle was made of rigid inflexible material.

Figure 19:
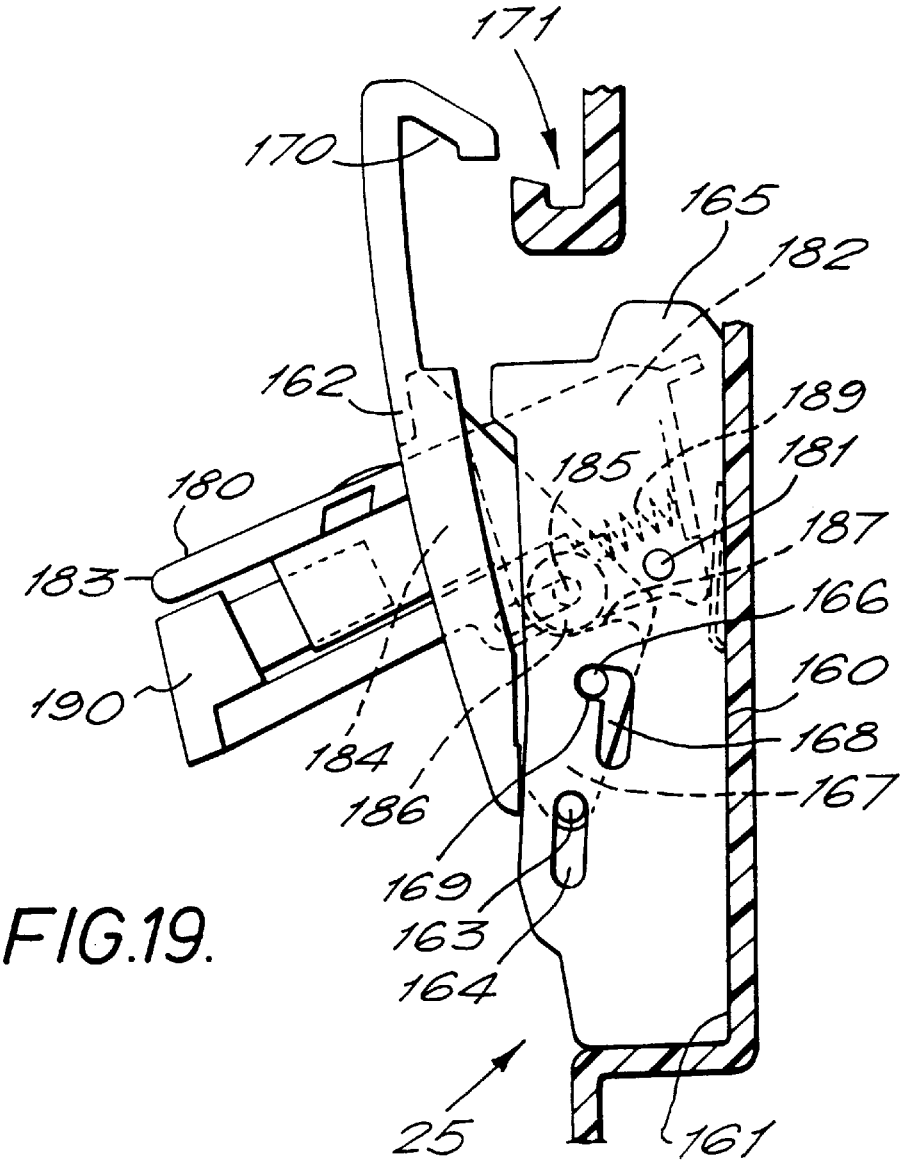
FIG. 19 shows a side elevational view of the central latch with the case wall in cross section.
Figure 20:
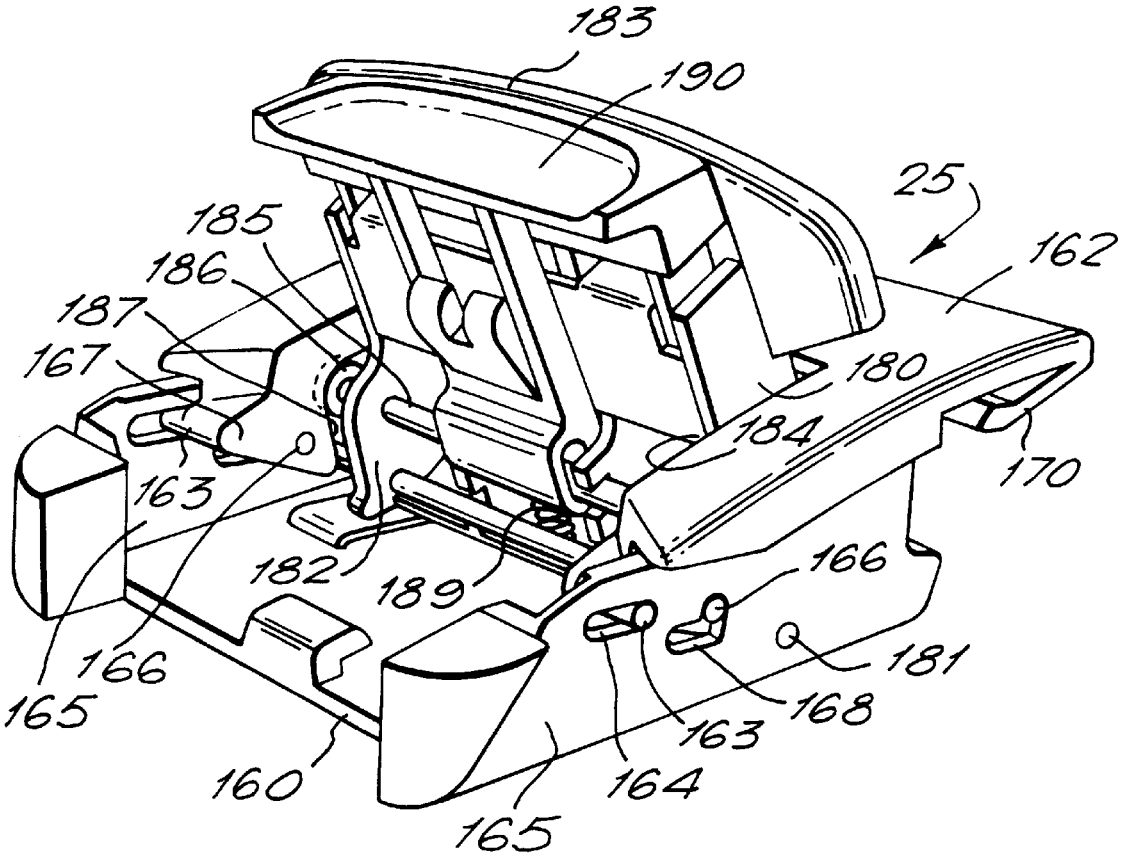
FIG. 20 shows a perspective view of a central latch.
Figure 21:
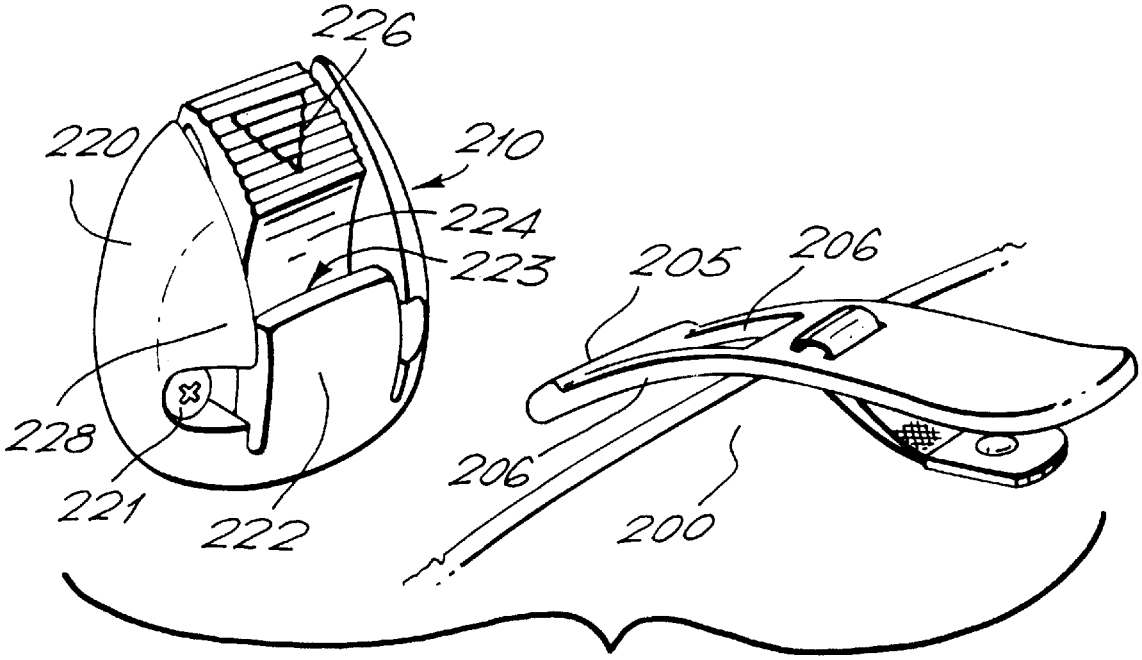
FIG. 21 shows a perspective detail of an arrangement for holding a dividing panel.
Figure 22:
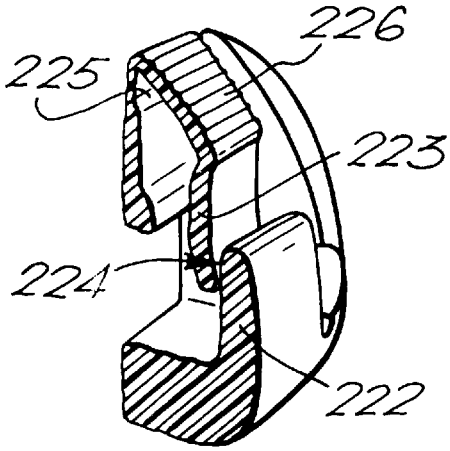
FIG. 22 is a cut-away view of the catch of FIG. 21.
Figure 23A:
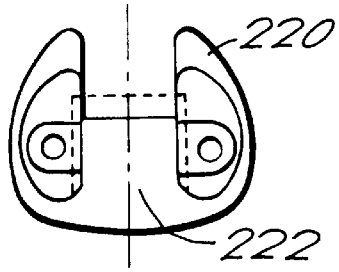
Figure 23B:
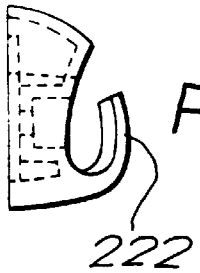
Figure 23C:
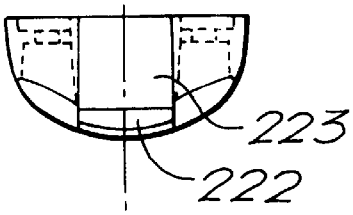
Figure 23D:
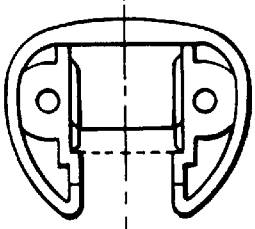

As stated previously, the central latch 25 is located underneath the handle between the gripping portion and the wall of the case. As the handle is fixed and does not pivot about a longitudinal axis at the points where it is fixed to the case, the access to the central latch is restricted. The central latch is constructed to facilitate operation in this restricted environment. FIGS. 19 and 20 show the central latch construction in detail.

The central latch comprises a base portion 160 which is secured in a recess 161 in the outside of the base shell of the case on the front wall below the handle. A claw portion 162 is pivotally connected to the base portion by pins 163 which fit into elongated slots 164 on side flanges 165 of the base portion. The claw portion 162 is also linked to the base portion by pins 166 which have a common axis parallel to the pins 163 and are mounted in lugs 167 on the claw portion. The pins 166 project into L-shaped slots 168 in the side flanges 165. The main portion of the slot 168 extends parallel to the slot 164. At the end of the slot 168 closest to the edge of the case is a sideways extension 169. The extension extends away from the case wall approximately at right angles to the main portion of the slot. The pins 166 and 163 cooperate with the slots 164 and 168 to guide the claw portion between the closed position and the open position of the latch. When the latch is opened, the pin 163 is at the upper end of the slot 164 nearest the edge of the case. The pin 166 is in the portion of the slot 169. Thus, the hook portion 170 of the claw is tilted away from the edge of the case. As the claw portion is moved downwardly, the pin 166 moves into the main portion of the slot 168 causing the claw portion to pivot about the pins 163 and the hook portion 170 to move towards the wall of the lid shell and engage in a recess 171. Further movement of the claw portion downwardly causes the pin 166 to move down the slot 168 and the pin 163 to move the slot 164 so that translational movement of the claw portion towards the base shell is achieved without substantial rotation of the claw portion about the pivot pin 163. The lid shell is thus drawn towards the base shell as the case is closed.

The movement of the claw portion described above is effected by a means of an operating lever 180 which is pivoted to the base portion by a pivot pin 181 which passes through lugs 182 on the operating lever and through the side flanges 165 of the base portion. The pivot pin is parallel to the pins 163 and 166. The lever 180 includes a gripping portion 183 which is accommodated in a cut-out 184 in the claw portion 162.

A shaft 185 passes through the lugs 182 on the underside of the lever and carries at its outer ends two rollers 186 which engage cam surfaces 187 on the claw portion. A spring 189 acts between the base portion and the lever 180 to bias its so as to pivot about the pin 181 away from the wall of the case. To close the latch, the user presses the gripping portion 183 towards the wall of the case and the lever pivots against the action of the spring 189 towards the base portion. The movement of the levers causes the rollers 184 in engagement with the cam surfaces 187 to swing in an arc towards the base and run down the cam surfaces. The cam surfaces are shaped so that the ends closest to the base portion are closer to the edge of the case than the portions which are furthest from the case wall. In consequence, as the rollers run down the cam surfaces 187, the claw portion is drawn downwardly causing it to execute first a rotational movement around the pivot pins 163 and then a translational movement drawing the two shells together. A catch 190 is provided in the lower end of the gripping portion of the lever 180 which functions in a similar manner to the catch 50 of the latches 23 and 24 to hold the lever in the closed position. To release the latch and open the case, the catch 190 is first released and the lever 180 is pulled outwardly, assisted by the spring 189 to allow the claw portion to move upwardly releasing the tightening pressure on the two shells and then to rotate outwardly lifting the hook portion 170 outer of the recess 171.

It will be appreciated that the latch construction allows fastening and unfastening of the latch in the confined region of the handle 21.

Figure 5:
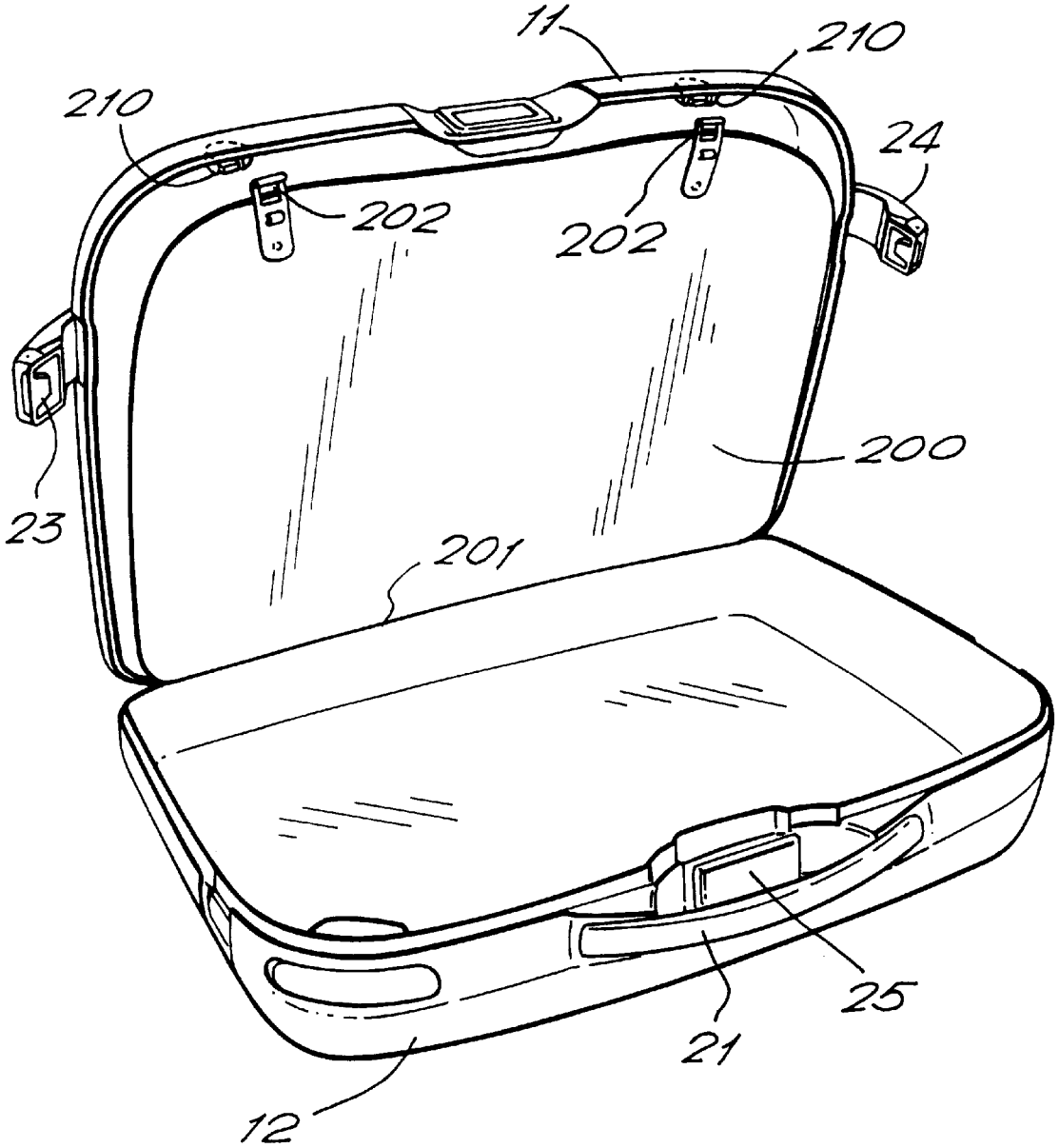
FIG. 5 shows a perspective sketch of the case in the open condition.

FIG. 5 shows a panel 200 which divides the space within the lid shell 11 from the space within the base shell 12. The panel 200 is hinged at its back edge 201 to the inside of the back wall of the case. At both ends of the front edge of the panel 200 is a loop 202 formed by a plastic moulding. The moulding includes a bar portion 205 connected to the panel by two strap portions 206 at each end.

On the inside of the lid shell near the corners between the front wall and the end walls are clips 210 which cooperate with the loops 202.

Each clip comprises a base portion 220 which is secured to the lid shell by screws 221. A hook or bracket portion 222 is supported from the base portion. The bar 205 of the loop portion can be hooked over the hook portion 202 to secure the front edge of the panel 200 to the lid shell.

A resilient detent 223 extends into the entrance of the bight 224 of the hook portion to prevent the bar accidentally coming off the hook. The detent comprises a tongue carried by a resilient bracket 225. The tongue forms a constriction in the mouth to the bight. The resilience of the bracket 225 causes the tongue to engage the back of the bracket 222. A gripping portion 226 is formed on the bracket 225. To widen the constriction in the entrance to the bight and allow the loop to be removed from the hook 222, the user presses on the gripping portion 226 to displace the tongue away from the hook portion 222 against the resilient action of the bracket 225. The base portion of the clip is formed with projecting portions or cheeks 228 on either side of the bracket 225 which projects as far as the gripping portion 226 to prevent the contents of the case being able to depress the gripping portion and thus accidentally allow the loop to come off the hook.

The clip 220 may be formed as a single moulding or as a two-piece moulding as illustrated in FIG. 23.

The construction of the catch mechanism described above enables the panel to be attached to the lid shell or released using single handed operation.

It will be appreciated that the luggage case described above has various novel features which may be used together as in the embodiment or separately.

We claim:

1. A luggage case comprising a base shell and a lid shell, each shell having a peripheral side wall, the side walls forming the front, back and end walls of the case, the two shells being hinged together at the back wall and having at least one latch for releasably fastening the shells together when the case is closed, at least a portion of the latch being mounted on the lid shell and being arranged to project away from the peripheral side wall when the latch is released so as to provide means for gripping and raising the lid shell to open the case, and wherein the edge of the base shell is formed with an outer lip, and the edge of the lid shell fits inside the said outer lip on the base shell when the case is closed, the latch includes a body portion which is mounted at its upper end to the lid shell for pivotal movement about a pivot axis substantially parallel to the end wall of the case, the body portion extending downwardly from the pivot axis and being movable between a closed position in which the body portion lies close to the wall of the case and an open position in which the body portion projects downwards and away from the wall of the case, and biasing means acting on the body portion to urge it towards the open position, the body portion carrying a latch portion for engaging the base shell when the body portion is moved to the closed position to draw the edges of the lid shell and base shell together.

2. A case according to claim 1 in which there are at least two latches mounted on the lid shell, one of the two latches being mounted on one of the end walls near the front wall of the case, and the other of the two latches being mounted on the other of the end walls near the front wall of the case.

3. A case according to claim 1 in which the body portion makes an angle of less than 40° to the wall of the case in the open position.

4. A case according to claim 3, in which the body portion makes an angle of approximately 20° to the wall of the case in the open position.

5. A case according to claim 3, in which the latch portion is pivotally mounted on the body portion on a second pivot axis, the latch portion projecting from the second pivot axis towards the first mention axis on which the body portion is mounted to the lid, the latch portion being pivotable between a closed position in which it lies close to the body portion and an open position in which it projects upwardly away from the body portion and towards the case, the latch portion carrying an abutment portion for engagement with a cooperating portion of the base shell to hold the shells together when the latch is closed.

6. A case according to claim 5, in which the abutment makes contact with the cooperating portion on a line which lies outside the plane joining the first and second pivot axis in the closed position, but inside the said plane in the open position so that the latch operates with a toggle action.

7. A case according to claim 6, in which part of the latch portion extends below the body portion to form a gripping portion of the latch that is gripped by the user when the latch is being released and the lid is being lifted, the second pivot axis lying closer to the wall of the case than the gripping portion so that upward pressure on the gripping portion tends to pivot the latch portion from the closed to the open position.

8. A case according to claim 6, in which the latch includes a catch mechanism for securing the latch portion to the body portion in the closed position.

9. A case according to claim 3, in which a part of the body portion abuts the wall of the lid shell or a mounting portion fixed to it in order to limit pivotal movement of the body portion away from the closed position under the action of the biassing means.

10. A luggage case according to claim 3, in which the latch or latches fit into a recess in the peripheral wall of the shell so as not to project substantially from the case when the latches are fastened.

11. A luggage case comprising a base shell and a lid shell, each shell having a peripheral side wall, the side walls forming the front, back and end walls of the case, the two shells being hinged together at the back wall and having at least one latch for securing the case together when closed, at least two castors, one of the said castors being mounted on the back wall of each of the shells, the castors being spaced at different distances from the hinge axis, a recess being provided between the castor furthest from the axis and the hinge axis to accommodate the castor on the other shell when the case is fully opened.

12. A case according to claim 11, in which centre of gravity of each castor is offset from the swivel axis so that when the case is placed on its bottom wall and the swivel axis is substantially horizontal the castors hang in a predetermined orientation.

13. A case according to claims 11 or 12, in which each castor includes a swivelling portion mounted on the swivel axis and in which a castor wheel is mounted for rotation about a wheel axis; the swivelling portion being asymmetric with respect to the axis of swivel axis of the castor, so that the centre of gravity of the said swivelling portion is offset in the same direction as the wheel axis of the castor wheel.

14. A case according to claim 13, including two coaxial wheels at a corner between the back wall and an end wall one of said wheels being mounted on each shell, one of the wheels being further from the hinge axis than the other wheel, a recess being provided in the back wall of the case between the wheel further from the hinge axis and the hinge to accommodate the other wheel when the case is fully opened.

15. A case according to claim 14, in which the swivelling portion of the castor farthest from the hinge includes a recess on the side opposite to the castor wheel, to provide clearance of the other castor.

16. A case according to claim 15, in which the said recess on the swivelling portion extends to the sides of the swivelling portion that normally face horizontally when the case is opened, to provide clearance for the other castor even when the said castor is not hanging with its centre of gravity immediately below the swivel axis.

17. A luggage case according to claim 12, in which the castors include a shroud which extends around the castor wheels to protect them from damage by collision with objects on the ground.

18. A luggage case comprising a base shell and a lid shell, the two shells being hinged together, and at least one latch for holding the case together when closed, and a carrying handle, the carrying handle being fixed to the wall of the case at its ends so as not to pivot relative to the case, a least a portion of the handle being made of a thermoplastic material that allows torsional twisting when the case is firmly held by the handle and the case sways from side to side, and in which the latch is located between a gripping portion of the carrying handle and the wall of the case.

19. A luggage case according to claim 18, in which the latch is a claw latch with a toggle action that draws the shells together as the latch is fastened.

20. A luggage case comprising a base shell and a lid shell, the two shells being hinged together along a back wall of the case, and a panel within the case for dividing the space within the lid shell from the space within the base shell, the panel being attached at its back edge to the interior of the back wall and having means for detachably securing its front edge to the lid of the case, the said means comprising loop attached to the panel and a hook attached to the inside of the lid shell, and a resilient detent being positioned adjacent the hook to prevent the loop from accidentally disengaging from the hook.

21. A luggage case according to claim 20, in which the loop is formed by a bar attached to the panel by a strap at each end.

22. A luggage case according to claim 21, in which the bar and each strap are formed integrally with one another.

23. A luggage case according to claims 20, 21, or 22 in which the hook has a bight formed therein, and the detent comprises a resilient tongue which projects into the entrance to the bight formed by the hook so as to form a constriction.

24. A luggage case according to claim 23, in which the detent includes a manually operable portion for displacing the tongue against the resilient action so as to widen the constriction and allow the loop to be released.

25. A luggage case having a base shell and having top, bottom, front, back and end walls, four wheels or castors being mounted on the back wall and a pulling handle assembly near the corner between the front wall and one of the end walls, the pulling handle assembly comprising a pulling strap attached at one end to a spool mounted inside the base shell of the case, the spool being spring loaded so as to wind in the strap when not in use, the strap passing to the outside of the case through a slot in the wall of the base shell and a handle grip being attached to the outer end of the strap, a recess being provided in the outside of the case at the said corner and the handle grip being shaped to fit into the recess when not in use, the handle grip and the recess are both elongate and the recess is longer than the handle so as to leave a space between the grip and the wall of the case when the grip is in the recess for insertion of the users finger to enable the grip to be lifted out of the recess, and in which the spool is housed in an enclosure within the base shell of the case and a security box is provided between the enclosure and the bottom wall for valuables and the like.

* * * * *